United States Patent [19]

Chiba et al.

[11] 4,254,746

[45] Mar. 10, 1981

[54] MEANS SILENCING SUCTION NOISE IN INTERNAL COMBUSTION ENGINES

[75] Inventors: Shoichi Chiba, Tokyo; Kunio Konuma, Shiki; Hirofumi Ishizaki, Kami-Fukoka, all of Japan

[73] Assignee: Honda Giken Kogyo Kabushiki Kaisha, Tokyo, Japan

[21] Appl. No.: 910,229

[22] Filed: May 30, 1978

[30] Foreign Application Priority Data

| | | | |
|---|---|---|---|
| May 30, 1977 | [JP] | Japan | 52-62934 |
| May 31, 1977 | [JP] | Japan | 52-63595 |
| May 31, 1977 | [JP] | Japan | 52-63596 |
| Jun. 23, 1977 | [JP] | Japan | 52-74751 |
| Jun. 23, 1977 | [JP] | Japan | 52-74752 |
| Jun. 1, 1977 | [JP] | Japan | 52-71377[U] |

[51] Int. Cl.[3] ..... F02M 35/00; F02B 27/00

[52] U.S. Cl. ..... 123/52 M; 181/229

[58] Field of Search ..... 181/229; 123/52 M, 52 MB, 123/52 MC, 52 MP, 59 PC

[56] References Cited

U.S. PATENT DOCUMENTS

| | | | |
|---|---|---|---|
| 2,340,152 | 1/1944 | Steensen | 181/229 |
| 2,482,987 | 9/1949 | McCollum | 181/229 |
| 2,954,096 | 9/1960 | McMullen | 181/229 |
| 3,712,416 | 1/1973 | Swanson et al. | 181/229 |
| 3,814,069 | 6/1974 | Croft et al. | 123/52 M |
| 4,016,838 | 4/1977 | Yoshioka et al. | 123/59 PC |
| 4,065,276 | 12/1977 | Nakaya et al. | 181/229 |
| 4,109,751 | 8/1978 | Kabele | 181/229 |

FOREIGN PATENT DOCUMENTS

| | | | |
|---|---|---|---|
| 2378183 | 8/1978 | France | 123/52 M |
| 0563383 | 8/1944 | United Kingdom | 181/229 |

*Primary Examiner*—Craig R. Feinberg

*Attorney, Agent, or Firm*—Irving M. Weiner; Pamela S. Burt; John L. Shortley

[57] ABSTRACT

A device for silencing suction noises wherein a suction passage making a combustion chamber of an engine and an expansion chamber communicate with each other through a suction valve, is also provided with a fuel feeding device interposed in the passage. A suction pipe makes the expansion chamber communicate with the atmosphere, and has a substantially constant cross-sectional area over its entire length. The expansion chamber is predetermined to have a cross-sectional area larger than that of the suction passage and to have a substantial volume. The ratio of the suction pipe length to the suction passage length is selected to be in a range of 0.7 to 1.4.

3 Claims, 47 Drawing Figures

MEANS SILENCING SUCTION NOISE IN INTERNAL COMBUSTION ENGINES

The invention relates to means for controlling and reducing suction noises of engines of motorcycles or the like, and particularly, of four-cycle engines.

More particularly, the invention relates to silencing means wherein a passage, making an expansion chamber communicate with a combustion chamber of an engine through a suction valve and fuel feeding device, is provided and the length of this suction passage, the length of a suction pipe for sucking the atmosphere into the expansion chamber, and the volume of the expansion chamber are of predetermined values to most effectively control and reduce suction noises. The invention further relates to silencing means wherein the cross-sectional area and position of the suction pipe is selected, sound absorbing material is used to promote the silencing, and the suction passage and/or suction pipe is provided with a resonator to control and reduce suction noises.

BACKGROUND OF THE INVENTION

FIG. 6 shows suction and fuel feeding systems of a known four-cycle internal combustion engine. A cylinder 1, slidably fitted with a piston 2, is covered by a cylinder head 1*a*. A combustion chamber 1*b* is formed above the upper surface of piston 2. Head 1*a* is provided with a suction port 1*c* and exhaust port 1*d* periodically opened and closed respectively by a suction valve 3 and exhaust valve 4. Port 1*d* communicates with an exhaust pipe through an exhaust passage 1*e*. A muffler unit to silence the exhaust is interposed in the exhaust pipe.

Port 1*c* communicates with a suction passage 1*f* and is connected to an outlet part of a carburetor 5 which is a fuel feeding device. Carburetor 5 is provided with: a venturi 5*a*; a nozzle 8*a* in venturi 5*a* feeding fuel from a float chamber 8; a throttle valve 6 in the passage on the down-stream side of venturi 5*a* controlling the cross-sectional area of said passage to regulate the flow of a gaseous mixture; and a choke valve 7 in the passage up-stream of venturi 5*a* controlling the cross-sectional area of the passage to regulate the volume of air. An air cleaner is connected to the inlet of carburetor 5 to clean air fed to the inlet.

In the suction system including the fuel feeding device, when air containing fuel is sucked in, suction noises are generated. By silencing not only the exhaust noises, but also the suction noises, the noises of the engine as a whole can be controlled to obtain a quiet engine.

Suction noises have been neglected as compared with countermeasures against exhaust noises. Suction noises are generated by the following causes.

The first cause in suction sounds in the fuel sucking stroke and such fundamental suction sounds as the sounds of the momentary reverse currents of the exhaust pressure and compression pressure by the timing of opening and closing the suction valve and air currents.

The second cause is pipe resonance sounds generated when the suction passage influences the suction efficiency and engine operation. The suction sounds comprise 20 to 25% of suction noise, and the pipe resonance sounds comprise 75 to 80% of suction noise.

In an automobile, substantially all of not only the air cleaner and carburetor, but also the suction and fuel feeding systems, are housed in the engine compartment shielded with the hood.

In a motorcycle, not only the engine but also the suction system and fuel feeding system are not shielded. If many various devices are used to quiet suction noises, the suction system will become too large and will impair the appearance and design of a motorcycle.

There is required a means to efficiently silence suction noises, but which is small and light as to be able to be set within limited space without impairing the appearance and design of a motorcycle.

SUMMARY OF THE INVENTION

The invention provides apparatus for silencing suction noises of an internal combustion engine. The apparatus includes at least one suction passage including a suction valve of the engine, a suction path conduit, and portions of a fuel feeding device for the engine. The apparatus also includes at least one suction pipe of substantially constant cross section having one end thereof communicating with the atmosphere. The apparatus also includes an expansion chamber disposed between and communicating with the suction passage and the suction pipe. The expansion chamber has a cross-sectional area larger than that of the suction passage, and a substantial volume. The ratio of the length of the suction pipe to the length of the suction passage is in a range of 0.7 to 1.4.

An object of the invention is to provide means for silencing suction noises in internal combustion engines wherein: a suction passage is formed by interposing a fuel feeding device in a passage connecting an expansion chamber with the combustion chamber; the length of the suction passage and the length of a suction pipe connecting the expansion chamber with the atmosphere are predetermined; and the volume of the expansion chamber is selected so that the pipe resonance sounds are reduced and the suction noises are silenced.

Another object is to provide silencing means wherein, when the length of the suction passage is L, and the length of the suction pipe is l, the ratio of l/L is in a range of 0.7 to 1.4, or preferably 0.9 to 1.2.

Another object is to provide silencing means wherein the ratio l/L is in a range of 0.7 to 1.4 and, in the relation between the volume V of the expansion chamber and the cross-sectional area S of the suction pipe, $L\sqrt{S/Vl} \leqq 0.32$ is satisfied so that the silencing is improved.

Another object is to provide means for silencing suction noises wherein the suction passage is independently provided in each cylinder of a multicylinder engine, and communicates with an expansion chamber, and the length of the suction passage and suction pipe meet the above conditions.

Another object is to provide silencing means wherein: the suction passage is independently provided in each cylinder of a multicylinder engine; the suction passages are collected in a single pipe before communicating with the expansion chamber; the resonance pressure sources of different phases of the suction passages are collected in the single pipe while under a high pressure so that the pressure sources of the respective suction passages may interfere with one another; and the pipe resonance sounds are attenuated and controlled.

The invention provides silencing means wherein: the suction noises are reduced without adding any special device or requiring great modification to the suction system; the structure is simple; and the cost is low.

Another object is to provide silencing means wherein the suction pipe has its outlet in an expansion chamber and separated by more than the pipe's diameter from any inner wall of the chamber so the reflection caused by the pressure fluctuation of noises is prevented from being discharged directly out of the chamber through the pipe.

Another object is to provide silencing means wherein the suction pipe is fitted with sound absorbing material, and the relation between the fitting position and fitting length of the sound absorbing material and the cross-sectional area of the pipe is predetermined to silence suction noises.

DETAILED DESCRIPTION

The closed pipe resonance generated in the suction passage constitutes the bulk of suction noises. Suction noises consist of fundamental suction sounds and pipe resonance sounds of the suction passage. Fundamental suction sounds include suction sounds having as a main component a low frequency of 100 to 200 Hz in the engine suction stroke, and sounds of the reverse currents of exhaust pressure having as a main component a frequency band of more than 1 kHz. Reverse currents of compression pressure and the currents of air will be generated mostly when the suction valve is opened somewhat prematurely by the sucking operation of the engine and the exhaust gas is reversed when the combustion ends and the exhaust gas is discharged. Fundamental suction sounds comprise about 20 to 25% of suction noises.

Pipe resonance sounds of the suction passage are noises generated when the suction stroke of the engine ends, and the suction valve is closed until the suction begins again, i.e., while no suction occurs, and having as a main component a low frequency of about 300 to 400 Hz. Pipe resonance sounds comprise 75 to 80% of the entire suction noises.

Figure 7:
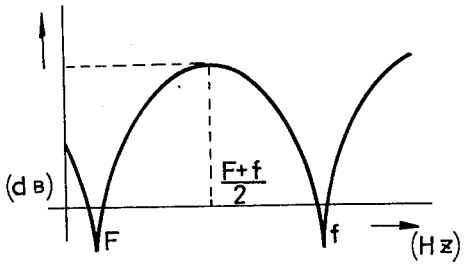
FIG. 7 is a graph showing a characteristic of pipe resonance noises.

It is necessary to conform the attenuation characteristic of an expansion type muffler to the pipe resonance sound $F_o$, i.e., to make $F_o$ requiring the most attenuation coincide with the frequency of maximum attenuation. When the natural vibration frequency of the muffler itself is F(Hz), and the resonance frequency of the suction system is f(Hz), the frequency at which maximum attenuation is obtained will become minimum at frequencies F and f and, as shown in FIG. 7, will become maximum at the frequency about ½ between these frequencies. The resonance frequency $F_o$, which can be made to coincide with the frequency at which maximum attenuation is obtained, is selected to be $$F_o \approx \frac{F+f}{2} \quad (1)$$

In FIG. 7, the abscissa represents frequency, and the ordinate represents attenuation.

The natural vibration frequency F and resonance frequency f are represented by $$F = \frac{C}{2\pi}\sqrt{\frac{S}{Vl}} \quad (2)$$

$$f = \frac{C}{2l} \quad (3)$$

F is proportional to the square root of the cross-sectional area S, but is inversely proportional to the square root of the volume V of the expansion chamber and the length l of the suction pipe.

The frequency f is proportional to the sound velocity C, but is inversely proportional to the length l of the suction pipe. The frequency range to be silenced is mostly low frequencies, less than 400 Hz. The lower the frequency F, the greater the silencing effect.

When F=0 (Hz) by assuming the case that it is the lowest, $$F_o \approx \frac{F+f}{2} \approx \frac{f}{2} \quad (4).$$

If L is the length of the suction passage, $$F_o = C/4L \quad (4')$$

If this and the above mentioned formula (3) are substituted in the formula (4), $$\frac{C}{4L} \approx \frac{C}{2l}/2.$$

Therefore, $$L \approx l \quad (5)$$

Theoretically this is the condition for greatest silencing efficiency.

Figure 1:
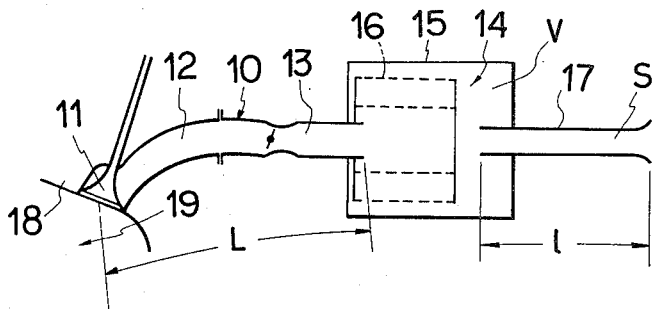
FIG. 1 is an explanatory view of a suction system.
Figure 2:
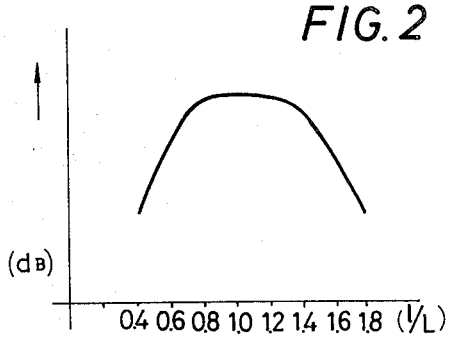
FIG. 2 shows attenuation as a function of the ratio of length of suction pipe to length of suction passage.

As a result of confirming the relation between the length L of the suction passage 10 shown in FIG. 1 and the length l of the suction pipe 17 by experiments, it has been found that an attenuation characteristic shown in FIG. 2 is obtained.

FIG. 1 is a schematic explanatory view of suction and fuel feeding systems, including a suction valve 11 of an engine 18, a suction path 12, and a carburetor 13 connected with it to form a suction passage 10. Passage 10 communicates at one end with an inlet port of a combustion chamber 19 of engine 18 through valve 11, and at the other end with an expansion chamber 14 formed by an air cleaner case 15 and housing an air cleaner element 16 within it. Chamber 14 communicates with the atmosphere through the opening of passage 10 and pipe 17 opening on the surface on the other side so as to take in the atmosphere. Chamber 14 is larger in cross-sectional area than passage 10. The cross-sectional area of pipe 17 is made substantially the same over its entire length. The opening in chamber 14 of pipe 17 and the opening in chamber 14 of passage 10 are so set as not to be opposed to each other without any interposition between them. Element 16 is interposed between them so that the pipe resonance sounds may not be discharged directly into the atmosphere through pipe 17, but may be silenced within chamber 14.

The attenuation characteristic by the selection of the ratio 1/L is shown in FIG. 2. Experiments were made on the basis of this selection, and the values are shown as a graph. The abscissa represents the ratio 1/L, and the ordinate represents attenuation in dB.

As shown by this graph, when the ratio 1/L is in the range 0.9 to 1.2, the silencing effect will be the greatest.

However, it is impossible that the natural frequency reduces to 0 Hz. As 0 Hz is approached, the effect will stop. By selecting a low frequency near 0 Hz, an expected practically sufficient object can be attained.

Thus, in the relation between the suction passage length L and suction pipe length l, the range in which this ratio 1/L is 0.7 to 1.4 is a range in which the silencing is practically high as shown in the graph. By determining the suction passage and suction pipe lengths within this range, the most efficient silencing is obtained.

Figure 4:
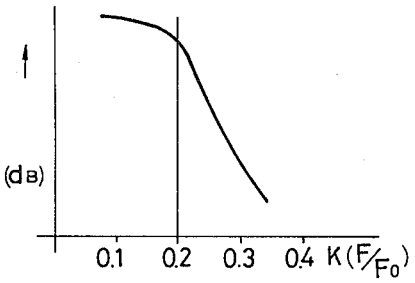
FIG. 4 is a graph showing the silencing effect on the relation between the pipe resonance frequency and the natural frequency of the muffler.

According to experiments, where the resonance frequency of passage 10 is $F_o$, and the natural frequency of the muffler is F, the relation between $K(F/F_o)$ and attenuation is shown in FIG. 4.

In FIG. 4 the abscissa represents $K(F/F_o)$, the ordinate represents attenuation in dB, and the indicating line shows experimental values. As shown by the indicating line, the attenuation varies greatly with $K(F/F_o)$ of substantially 0.2 as a boundary and, below 0.16, the attenuating effect is favorable but tends to stop and become saturated. Above 0.2, a remarkable deterioration of the attenuating characteristic occurs. K is a constant related to the frequency.

As the frequency of the suction passage is $$F_o = C/4L \quad (4'),$$

if this formula and formula (2) are substituted in $K(F/F_o)$, $$K(F/F_o) = \frac{C}{2\pi}\sqrt{\frac{S}{Vl}} \Big/ \frac{C}{4L} = \frac{4L}{2\pi}\sqrt{\frac{S}{Vl}} = \frac{2L}{\pi}\sqrt{\frac{S}{Vl}} \quad (6).$$

When this is further rewritten, $$\frac{\pi}{2}K(F/F_o) = L\sqrt{\frac{S}{Vl}} \quad (7).$$

Figure 3:
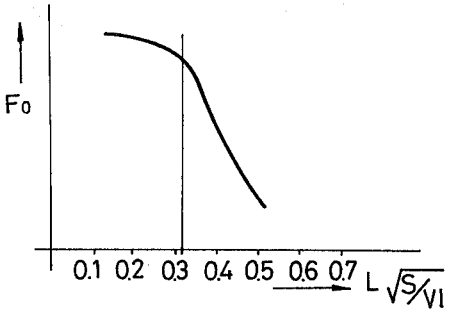
FIG. 3 is a graph showing attenuation of pipe resonance sounds as a function of $L\sqrt{S/V}$.

The relation of the respective frequencies includes the relation of the volume V of chamber 14, the cross-sectional area S of pipe 17 in relation to the length L of passage 10 and length l of pipe 17 as in formula (7). As shown in FIG. 3, a great variation of the attenuation characteristic occurs with $L\sqrt{S/Vl}$ of about 0.3 as a boundary.

In FIG. 3 the abscissa represents $L\sqrt{S/Vl}$, and the ordinate represents attenuation of $F_o$ in dB. The values at, above and below $$L\sqrt{S/Vl} = 0.32$$

are actually-obtained attenuations. By simultaneously satisfying the conditions of $L\sqrt{S/Vl} \leqq 0.32$, and the ratio 1/L in a range of 0.7 to 1.4, an efficient muffler can be obtained. The number of the cylinders of the engine is not referred to in the above, but the relationships also apply to multicylinder engines.

Figure 5:
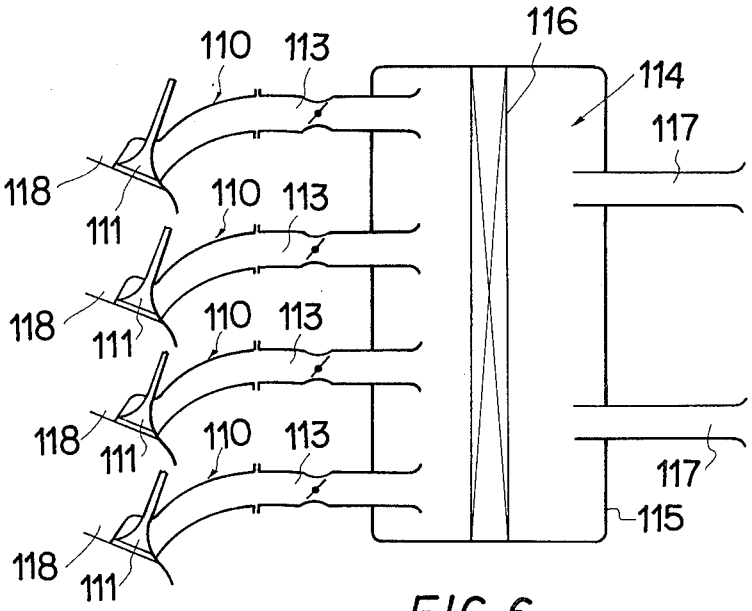
FIG. 5 shows an embodiment applied to a multicylinder engine.
Figure 6:
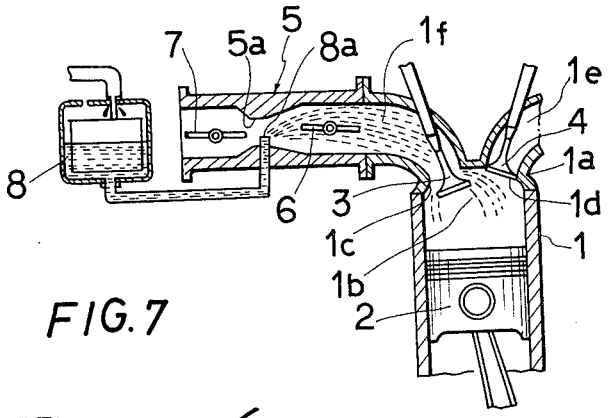
FIG. 6 PRIOR ART
FIG. 6 shows a prior art suction system.

In FIG. 5, a multicylinder engine, viz., a four-cylinder engine, is shown. Suction valve 111 of each of cylinders 118 is independently provided with a suction passage 110, including a carburetor 113 communicating with an expansion chamber 114, by an air cleaner case 115 having an air cleaner element 116. A plurality of suction pipes 117 connect chamber 114 with the atmosphere. In the illustrated embodiment, two pipes 117 are provided. Even in a multicylinder engine, an efficient muffler can be obtained by setting the ratio l/L of the length l of pipe 117 to the length L of each passage 110 to be in the range of 0.7 to 1.4 to attenuate suction noises.

Figure 8:
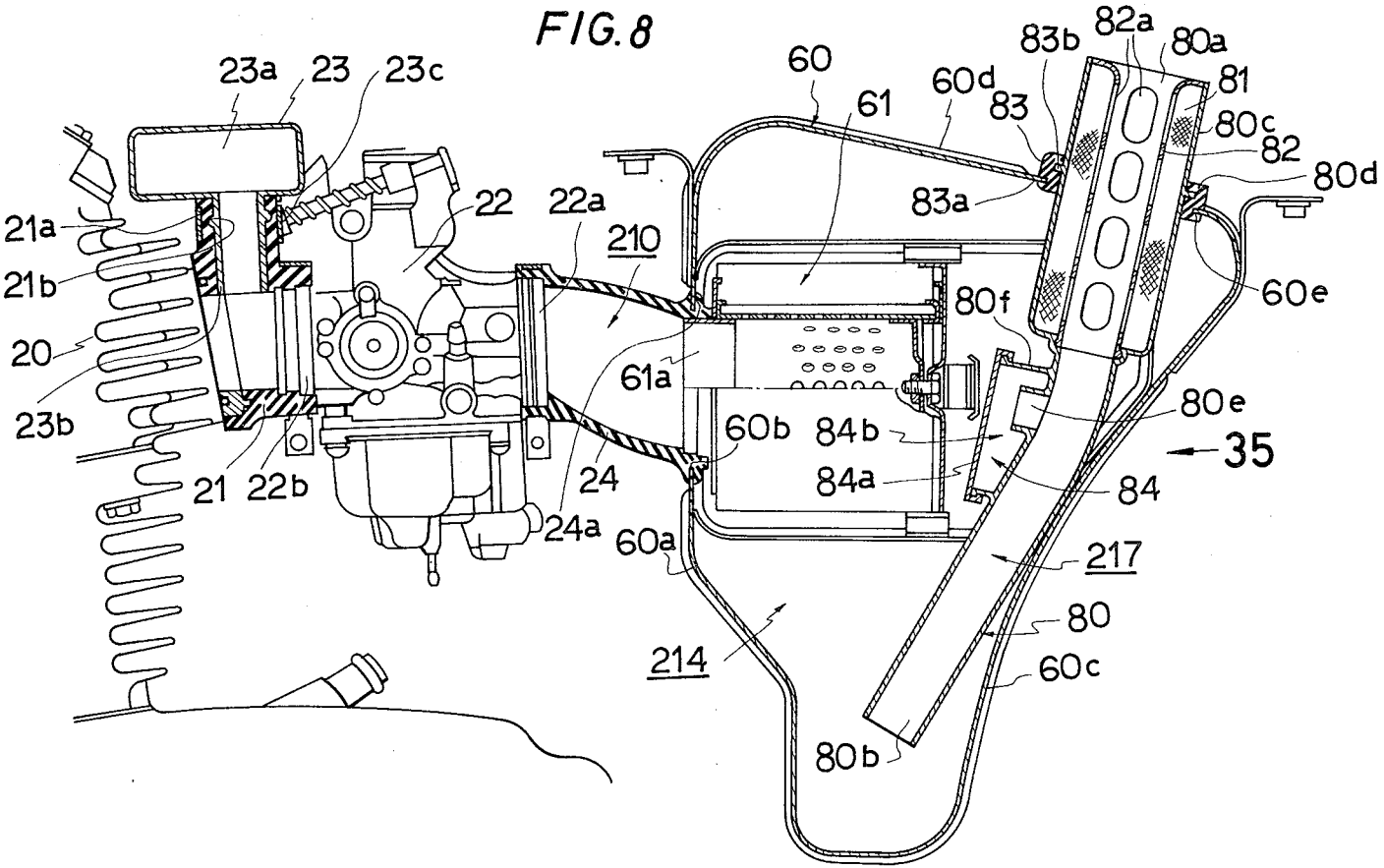
FIG. 8 is a side view showing another embodiment of the invention.

FIG. 8 shows a specific embodiment of the invention applied to a motorcycle.

A four-cycle engine 20 has a suction passage, operated to be opened and closed by a suction valve (not shown), which is connected with a connecting pipe 21 made of durable and anti-corrosive rubber or the like at its front end. Pipe 21 is connected at its rear end with an outlet part **22*b* of a carburetor 22, and is provided in its center part with a resonator 23 directed upwardly. Resonator 23 has a sealed chamber 23*a* and a conduit pipe 23*b* communicating with a part of chamber 23*a* so that the interiors of pipe 21 and chamber 23*a* communicate with each other through pipe 23*b*. Pipe 23*b* is fitted in a cylinder part 21*a* provided to project upwardly from the center part of pipe 21. A ring-shaped concave part 21*b* provided on the inner wall of 21*a* and a ring-shaped projection 23*c* provided on the outer wall of pipe 23*b* are engaged with each other to prevent pipe 23*b* from being pulled out. Part 21*a* is formed of rubber to seal pipe 23*b*** by its flexibility and elasticity. The silencing effect is improved by such resonator.

Carburetor 22 is connected by an inlet part **22*a* with a connecting pipe 24. Pipe 24 is fitted to the periphery of an opening 60*b* in rear wall 60*a* of an air cleaner case 60 through an annular groove 24*a*. The opening part at the rear end present in the case opening 60*b* of pipe 24 is in a cleaned air outlet part 61*a* of an air cleaner element 61 fitted in case 60. Case 60 has a substantially sufficient volume and an expansion chamber 214. A suction passage 210 is formed by pipe 21, carburetor 22 and pipe 24**.

A suction pipe 80 is provided diagonally and vertically within case 60. Pipe 80 is mostly present in case 60 and its outlet part **80*b* is separated by more than its diameter from the front wall part 60*c* of case 60. Inlet part 80*a* of pipe 80 projects a suitable length out of an opening 60*e* in upper wall 60*d* of case 60. Sound absorbing material 81 is put over a suitable length in tip part 80*c* including the projecting part of pipe 80 to surround it. Material 81 surrounds the outer periphery of a cylindrical holder 82 in the tip part of pipe 80 and is held between the outer periphery of holder 82 and the inner periphery of part 80*c*. Holder 82 has in its peripheral wall many small holes 82*a*. A flange part 80*d* on part 80*c* engages with an inside diameter groove 83*b* of a fitting member 83, made of rubber, locked by a groove 83*a* in opening 60*e* to seal and fit pipe 80 to case 60. A resonator 84 is provided in pipe 80 to make a cylinder hole 80*e* communicate with the interior of the pipe. Resonator 84 has on its outer periphery a rising wall 80*f* which is closed on the top with a cap 84*a* to make a chamber 84*b*. The silencing effect is thus increased and a suction pipe path 217** is formed.

Even in the above suction system, the passage length, pipe length and air cleaner case volume are predetermined. The relation of the suction pipe with the air cleaner case and the setting position of the resonator are so selected as described below.

An embodiment in which the suction passages of the above mentioned multicylinder engine are collected shall be explained in the following.

In FIG. 5, the suction passage for each cylinder is independently provided and is connected separately to the air cleaner case. Pipe resonance sounds will be generated independently in each passage and, if they are to be silenced in the expansion chamber, even if the above conditions are satisfied, the pressure of the pipe resonance pressure waves of each passage will be released and reduced within the expansion chamber, but sufficient interfering action will be difficult to achieve.

Therefore, the suction passages of the respective cylinders are collected up-stream, and the resonance pressure waves of different phases of the cylinders are collected in a single collecting pipe where the pressure is great so that the pressure waves of the respective suction passages may interfere with one another.

Figure 9:
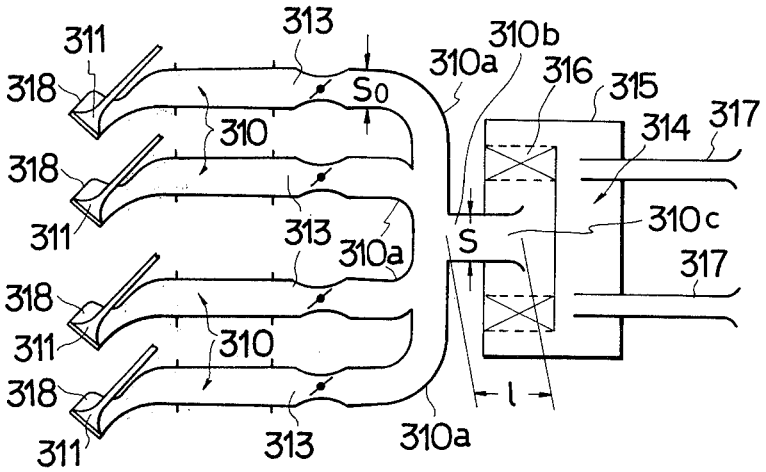
FIG. 9 is an explanatory view of a muffler collecting the respective suction passages of a multicylinder engine.

FIG. 9 shows a suction passage 310 provided for each cylinder. As the embodiment is of a four-cylinder engine, four suction passages are provided. Each passage 310 is independently provided with a suction valve 311 and carburetor 313.

Passages 310 are bent in part **310*a* on the up-stream side of carburetor 313, and are collected in a single collecting pipe 310*b*. Pipe 310*b* is connected through an up-stream end opening 310*c* with an expansion chamber 314 having air cleaner case 315 and air cleaner element 316 so that passages 310 communicate with chamber 314 through pipe 310*b*. Chamber 314 communicates with the atmosphere through two suction pipes 317**.

Passages 310 generate pipe resonance sounds. Because the strokes of the various pistons and the opening and closing of valves 311 do not coincide, the pipe resonance sounds do not coincide with one another in phase. The resonance pressure waves of the respective passages differing in phase are collected in pipe **310*b* in which the waves interfere with one another and are attenuated by this interfering action. This interfering action occurs within pipe 310*b* while the pressure is high and before being reduced by the pressure waves radiating into chamber 314**.

The above action of pipe **310*b* can be effectively made by properly selecting the cross-sectional area and length of pipe 310*b***, and can be utilized also as a means of increasing the output as in the conventional pulsating effect.

Figure 10:
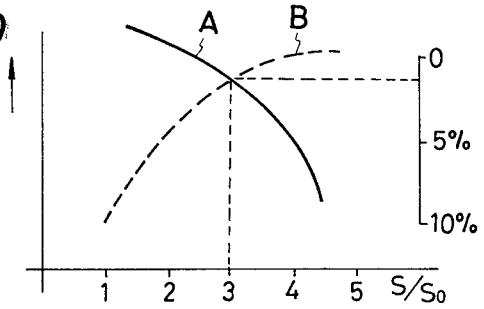
FIGS. 10 and 11 are graphs showing experimental values of the FIG. 9 apparatus.

FIG. 10 is a graph of actually measured influences of the relation of cross-sectional area S of pipe **310*b* and cross-sectional area $S_o$ of passage 310** on the pipe resonance sounds. The abscissa represents the ratio $S/S_o$, and the left ordinate represents attenuation. The right ordinate represents output reduction rate of the engine in %.

Line A is the attenuation characteristic of the pipe resonance sounds, and line B is the output reduction characteristic of the engine. The smaller the $S/S_o$, the larger the attenuation; and the larger the $S/S_o$, the smaller the attenuation. The smaller the $S/S_o$, the higher the pressure under which the resonance pressure waves interfere with each other, and the greater attenuation. The ventilation resistance will increase and the engine output will reduce as shown by line B. The ratio $S/S_o$ of about 3, where lines A and B intersect, is a value satisfying both the silencing effect and engine output.

Figure 11:
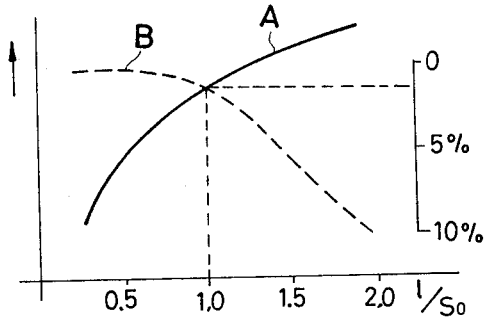

FIG. 11 is a graph showing the results of actually measuring the influence of the relation of cross-sectional area $S_o$ and pipe length l of the collecting pipe 310*b* on the pipe resonance sounds. The abscissa represents $l/S_o$, and the ordinates represent attentuation and engine output reduction rate as in FIG. 10. Line A is the resonance sound attenuating characteristic, and line B is the engine output reduction characteristic.

When $l/S_o$ increases, attenuation increases but the output of the engine will decrease as in line B. The ratio $l/S_o$ of about 1.0 where lines A and B intersect simultaneously satisfies the silencing effect and engine output.

Figure 12:
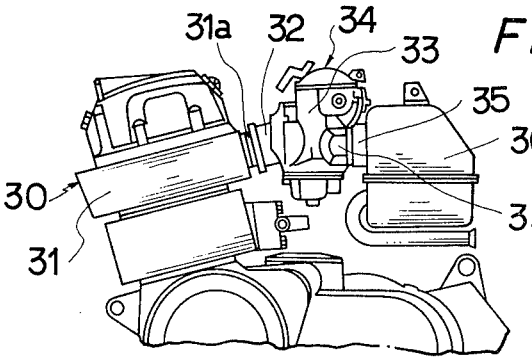
FIG. 12 is a side view of the engine and suction system of another embodiment.
Figure 13:
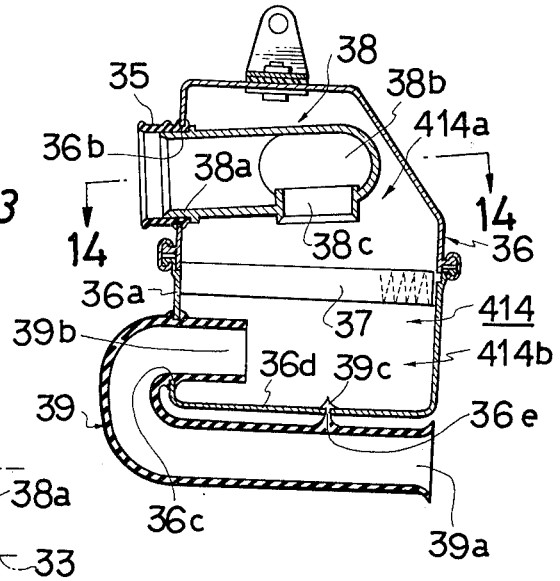
FIG. 13 is a magnified vertically sectioned side view of the FIG. 12 air cleaner case including a collecting passage.

FIG. 12 shows a four-cylinder motorcycle engine 30. Carburetor 33 communicates with suction port 31*a* of cylinder head 31 through connecting pipe 32, and four independent suction passages are provided. Pipe 32 and carburetor 33 are individually independently provided for each of the four cylinders. Inlet part 33*a* of each carburetor 33 is connected to a branched outlet part 38*a* (FIG. 13) of collecting pipe 38 through connecting pipe 35, such as a rubber tube. Pipe 35 is fitted to opening 36*b* provided in the front wall 36*a* of an air cleaner case 36. Part 38*a* is mostly housed in an upper chamber 414*a* sectioned with an element 37 of case 36. Case 36 has a substantial volume expansion chamber 414.

Figure 14:
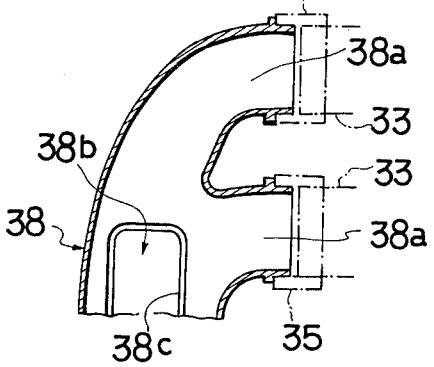
FIG. 14 is a sectioned view on line 14—14 of FIG. 13, showing only half the structure.
Figure 15:
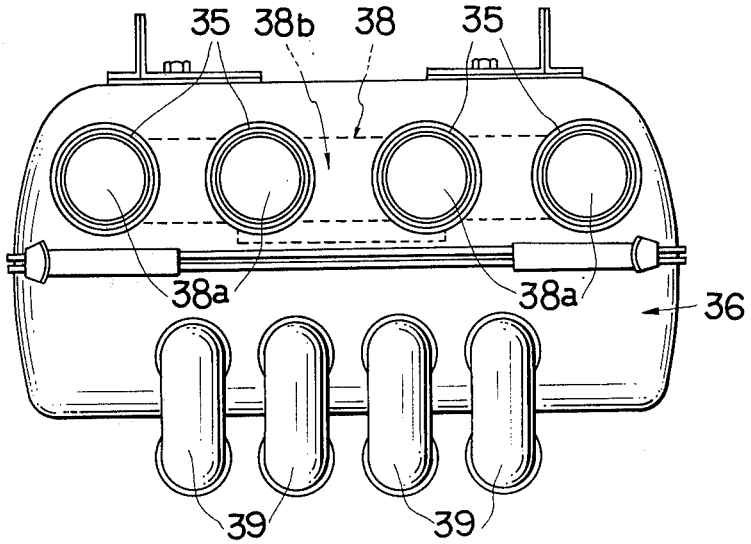
FIG. 15 is an end view of the FIG. 12 air cleaner case on the down-stream side.
Figure 16:
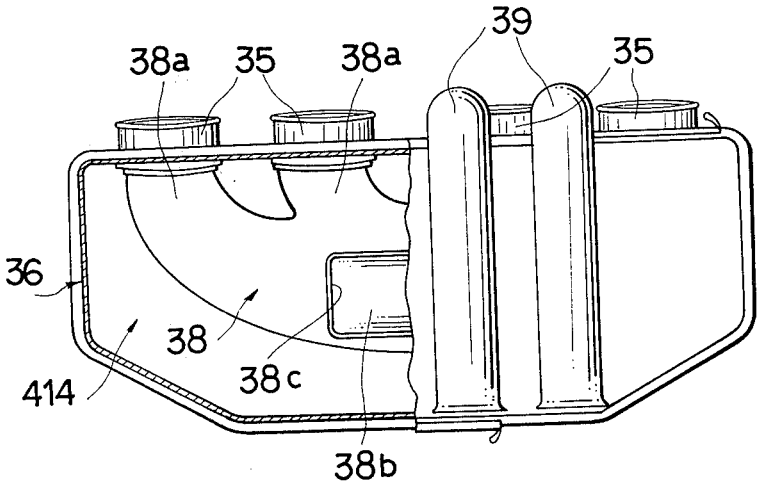
FIG. 16 is a half cut bottom view of FIG. 15.

Pipe 38 (FIGS. 14, 15 and 16) has a collecting part 38*b* in which parts 38*a* join together. Part 38*b* has an opening 38*c* communicating with chamber 414*a*.

Lower chamber 414*b* partitioned by element 37 communicates with the atmosphere through suction pipe 39 which is U-shaped of rubber or the like and whose outlet part 39*b* fits through a fitting hole 36*c* in wall 36*a*. Pipe 39 is locked and supported by a projection 39*c* and an engaging hole 36*e* (FIG. 13) in bottom wall 36*d* of case 36. Inlet part 39*a* is below case 36 and opens rearwardly. Pipe 39 reduces in the projection in the forward and rearward direction of case 36 while having a predetermined pipe length. Case 36 is dividable above and below the crossing part of element 37, and its upper and lower members are connected by a clamping member.

The resonances of the pipes including the carburetors join together in part 38*b*, wherein the waves interfere with one another to be attenuated. Then the waves are radiated into chamber 414, and further attenuated by the expanding action.

Pipe resonance and reverse flow of the exhaust pressure are attenuated by chamber 414. The pressure fluctuation within chamber 414 becomes maximum when the waves collide with and reflect on the inside surfaces of case 36. The nearer to the wall surface the open end of pipe 39, the more remarkable the outward radiation of the noises through pipe 39.

To improve the silencing, it is preferable to select as follows the arrangement of the suction pipe while satisfying the above.

Figure 17:
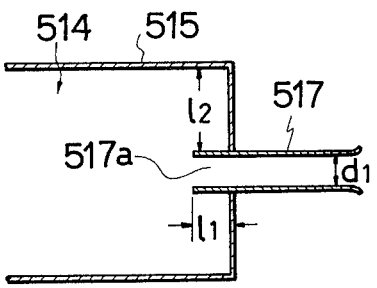
FIG. 17 is an explanatory view of an embodiment showing the relation between the expansion chamber and suction pipe.
Figure 18:
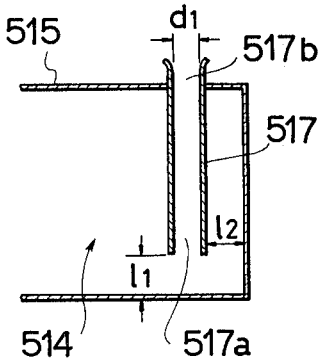
FIG. 18 is an alternate embodiment of FIG. 17.

FIGS. 17 and 18 show embodiments of fitting a suction pipe 517 to an expansion chamber 514. Chamber 514 is formed by an air cleaner case 515 and having an air cleaner element (not shown). Chamber 514 communicates with a suction passage including a fuel feeding device and a suction valve. Pipe 517 has a substantially constant cross section, and has its outlet opening part 517*a* projecting well into chamber 514. In FIG. 17, pipe 517 is horizontally arranged. In FIG. 18, pipe 517 is vertically arranged so that the greater part, except inlet part 517*b*, is present in chamber 514.

In both above cases, the relation between part 517*a* and the inner wall surface of chamber 514 is selected as follows. Where the distances between part 517*a* and the inside surfaces of the walls nearest to it are $l_1$ and $l_2$, and the inside diameter of pipe 517 is $d_1$, when $d_1$ is constant, for example, 35 mm., $l_1(l_2)/d_1$ should be 1 or more.

Figure 19:
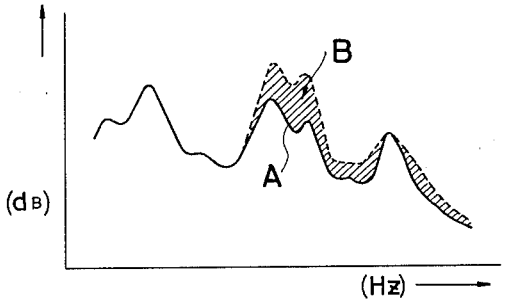
FIG. 19 is a graph of the noise radiation level improved by the FIG. 17 or 18 device.

In FIG. 19, $d_1$ is 35 mm., and $l_1$ is varied. The abscissa represents frequency in Hz, and the ordinate represents noise radiation level in dB. In a structure in which $l_1$ or $l_2$ is 0, i.e., pipe 517 is in contact with a wall surface, the radiated noises will be great as shown by hatched area B near a predetermined frequency in the low range in the indicating line A. On the other hand, when $l_1$ or $l_2$ is, for example, 35 mm., the noises near such frequency will be silenced very effectively.

Figure 20:
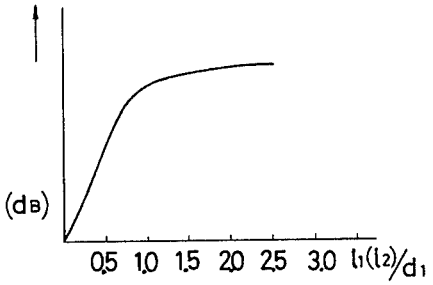
FIG. 20 is a graph showing the attenuating characteristics of the FIG. 17 or 18 device.

When $l_1$ or $l_2$ is increased and its ratio to the above mentioned inside diameter $d_1$ is determined, the attenuation curve is shown in FIG. 20. The abscissa represents attenuation in dB. A desirable effect of attenuating the noises is seen near $l_1(l_2)/d_1 = 1.0$, and above 1.0 until 2.5 the attenuation is saturated and improvement in the attenuation stops. When $l_1(l_2)/d_1 \geqq 1.0$, the outward radiation of noises through the suction pipe by the pressure fluctuation within the expansion chamber is controlled and reduced, and the silencing effect is increased.

By fitting the suction pipe with sound absorbing material, a further noise silencing effect is obtained and, by determining the fitting position of the sound absorbing material, the silencing effect is further improved.

Figure 21:
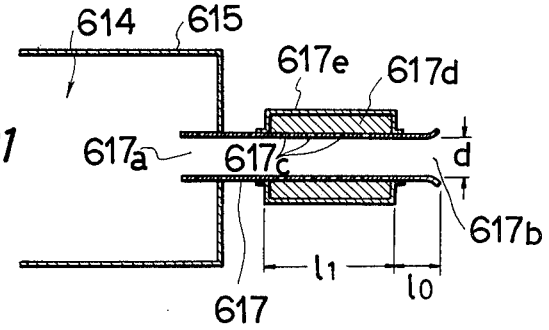
FIG. 21 is an explanatory view of an embodiment of fitting the suction pipe with sound absorbing material.

FIGS. 21 to 24 illustrate the foregoing. FIG. 21 shows an air cleaner case 615 wherein an expansion chamber 614 is formed and an air cleaner element (not shown) is fitted. The expansion chamber is connected to a suction passage as described above. A suction pipe 617 has its outlet part 617*a* at the upstream end of chamber 614. Pipe 617 has a substantially constant cross section. Chamber 614 communicates with the atmosphere through inlet part 617*b* of pipe 617. Many small holes 617*c* are in the wall of pipe 617. On the outer periphery of the part of pipe 617 having holes 617*c*, a sound absorbing material 617*d*, such as glass wool, is wound and fitted to surround it. A holder 617*e*, joined at both ends to the outer periphery of pipe 617, holds the material 617*d*.

The pressure fluctuation by the on pipe resonance sounds on down-stream side and the fundamental suction sounds are radiated and leaked out of chamber 614 through pipe 617. Noises passing through pipe 617 are exposed to material 617*d* and are thereby absorbed to obtain a further silencing effect.

The fitting position of material 617*d* in the lengthwise direction of pipe 617 is important. By the selection of this fitting position, the suction noises can be effectively controlled and attenuated. Where the distance between part 617*b* and the up-stream end of material 617*d* is $l_o$, and the inside diameter of pipe 617 is d, the relation $$l_o/d \leqq 0.5$$

should be satsified to obtain improved silencing.

Figure 22:
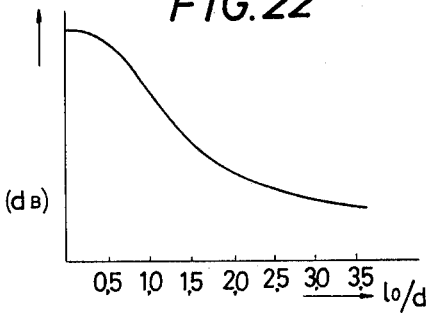
FIG. 22, 23 and 24 show noise attenuation characteristics of the FIG. 21 embodiment.

FIG. 22 shows the above relation and the attenuation of noises confirmed by experiments. The abscissa represents $l_o/d$, and the ordinate represents attenuation in dB. When $l_o/d$ is equal to or less than 0.5, the effect on attenuating the suction noises is excellent. When $l_o/d$ exceeds 0.5, the attenuating effect reduces.

The amount of material 617*d* in the lengthwise direction of pipe 617 while satisfying the above relation is also important to effectively control and reduce suction noises. Where the length of material 617*d* from its upstream end to its down-stream end is $l_1$, and the cross-sectional area of pipe 617 is S, when the relation between them is $l_1/S \geqq 1$, the attenuation of the suction noises as is shown in FIG. 23 will be effectively made.

Figure 23:
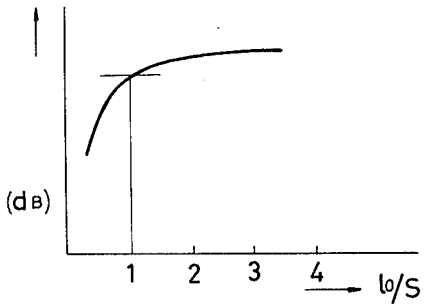

In FIG. 23 the abscissa represents $l_1/S$, and the ordinate represents attenuation in dB. When $l_1/S$ is below 1, the attenuating effect reduces. When $l_1/S$ is above 1, the suction noises are effectively attenuated. For effective design and economy $l_1/S$ should be set to a value larger than but near to 1.0.

Figure 24:
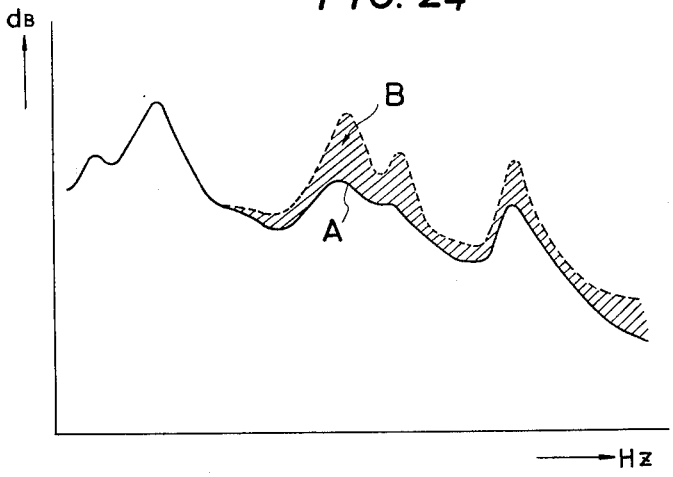

By satisfying the formulas $l_1/S \geqq 1$ and $l_o/d \leqq 0.5$, optimum control and attenuation can be attained. This is shown in FIG. 24 wherein the abscissa represents frequency in Hz, and the ordinate represents attenuation in dB. As shown by line A, near a predetermined frequency, as in hatched part B where the selection of the sound absorbing material is not set as mentioned above, much noise will occur. In the invention, as shown by line A, the noises near such frequency are effectively silenced.

An embodiment in which a resonator is provided to further control pipe resonance of the suction passage is explained as follows. When the lengths of the suction passage and suction pipe and the volume of the expansion chamber are selected as described above, a remarkable effect of silencing the noises is obtained. If a resonator is attached, the silencing effect is further improved. It is known that the resonator is effective to efficiently attenuate and reduce the noises particularly of a fixed frequency. The invention selects the fitting position and volume of the resonator to control and attenuate suction noises.

Figure 25:
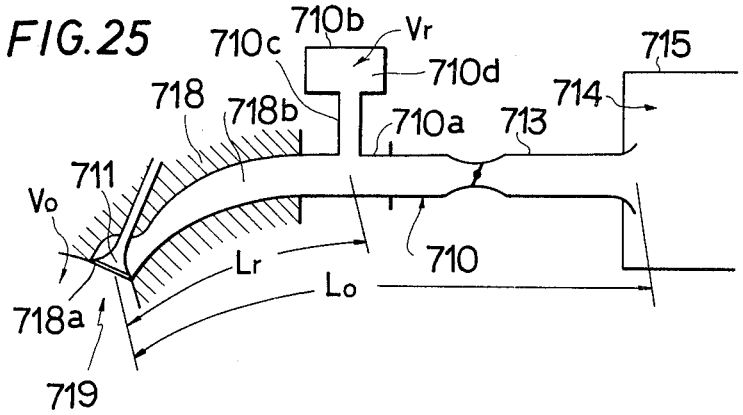
FIG. 25 is an explanatory view of an embodiment providing the suction passage with a resonator.

FIG. 25 shows an embodiment wherein a suction passage is provided with a resonator. Cylinder head 718 has a suction port 718*a* fitted with a suction valve 711 that periodically opens and closes. Port 718*a* communicates with suction passage 718*b* connected to a connecting pipe 710*a* and carburetor 713 to form suction passage 710. The inlet part of carburetor 713 at the upstream end of passage 710 communicates with expansion chamber 714 within air cleaner case 715. Chamber 714 communicates with the atmosphere through suction pipes, and peridically communicates with combustion chamber 719.

Passage 710 has a resonator 710*b* which is a sealed box-shaped body molded integrally of a synthetic resin to have a proper volume, and has a communicating part 710*c* through which the interior of chamber 710*d* of resonator 710*b* communicates with passage 710. Chamber 710*d* is above passage 710 to prevent fuel from entering the resonator and remaining in it.

Figure 26:
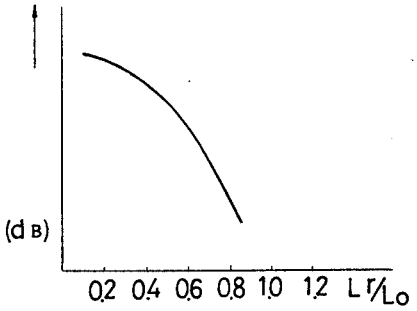
FIGS. 26 to 28 are graphs explaining the FIG. 25 embodiment.

Pipe resonance sounds are caused by suction sounds generated in passage 710. To silence them, resonator 710*b* is provided near the closing side of passage 710, i.e., the suction valve 711 side, so that the pipe resonance or pulsating pressure is attenuated near its generating position.

Where the length of passage 710 from valve 711 to the inlet part of carburetor 713 is $L_o$, and the length from valve 711 to part 710*c* is $L_r$, and the optimum position is determined by varying $L_r$, the results obtained are shown in FIG. 26.

In FIG. 26, the abscissa represents the ratio $L_r/L_o$, the ordinate represents attenuation in dB, and the attenuation curve obtained by varying the position of resonator 710*b* is shown by the indicating line.

When $L_r/L_o$ is larger than 0.4, the attenuation decreases markedly; and when it is below 0.4, a desirable attenuation is obtained. When the position of resonator 710*b* is regulated to be within the range of $L_r/L_o=0.4$, a desirable attenuation of suction noises is obtained. Below such value, it is difficult to provide a resonator on head 718. Therefore, the resonator is set within the above range of passage 710 not including the suction gas passage in head 718.

Figure 28:
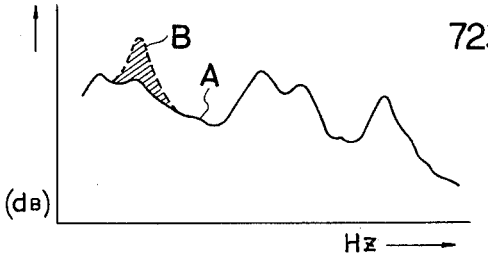

In FIG. 28 the abscissa represents frequency in Hz, and the ordinate represents noise level in dB. Near a predetermined frequency in the low range, as in the hatched part B, the noise level is great. By setting the resonator in the above mentioned position, the noises in part B are effectively silenced.

Attenuation of pipe resonance sounds depends also on the volume of resonator 710*b*. Where the volume of the resonator is $V_r$, the displacement or swept volume per cylinder of the engine is $V_o$, and the ratio $V_r/V_o$ is varied, the results are shown in FIG. 27.

Figure 27:
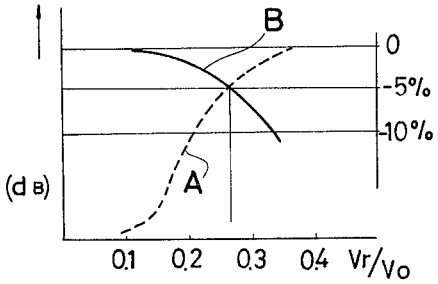

In FIG. 27, the abscissa represents $V_r/V_o$, the left ordinate represents attenuation in dB, and the right ordinate represents engine output. Line A shows that when $V_r/V_o$ is above 0.15, the attenuation increases markedly. It is desirable that the volume of the resonator is more than 0.15 that of displacement per cylinder, i.e., $V_r/V_o \geqq 0.15$.

The setting of the resonator is closely related to engine output. Generally, in a high output engine, the pipe resonance or pulsating pressure is used as a means of increasing engine output. But torque will reduce and the combustion condition will deteriorate in the medium and low rotation ranges.

Line B in FIG. 27 shows that when the volume of the resonator increases, the engine output will reduce; and when such volume decreases, the pulsation pressure will increase. Therefore, considering both engine output and the attenuation of the noises, the volume of the resonator is determined within the above mentioned range of $V_r/V_o=0.15$.

By so setting the resonator, the pulsation pressure by the pipe resonance as mentioned above can no longer be effectively utilized. However, by properly setting the resonator in relation to the setting position and volume, a stable combustion condition and torque are obtained over a wide rotation range and are reduced.

Figure 29:
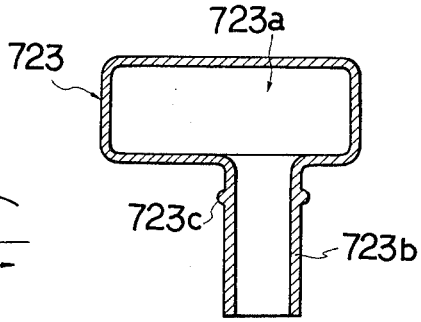
FIG. 29 is a vertically sectioned view showing a specific embodiment of the resonator.

FIG. 29 shows an embodiment of only a specific resonator for use with the FIG. 8 structure. A resonator 723 is provided with a resonance chamber 723*a* having a predetermined volume. A cylindrical part 723*b*, suspended down from chamber 723*a*, forms a communicating part with the suction passage. A ring-shaped projection 723*c* is provided in the upper portion of the outer periphery of cylindrical part 723*b* and is integrally molded from plastic.

Figure 30:
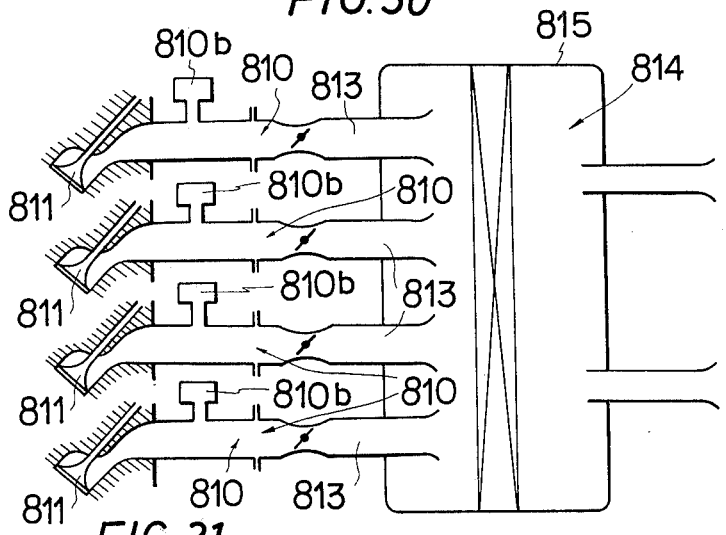
FIG. 30 is an explanatory view of an embodiment applied to a multicylinder engine.

FIG. 30 shows a multicylinder engine wherein each suction passage 810 has a carburetor 813 and suction valve 811 for each cylinder, and communicates with an air cleaner case 815 forming an expansion chamber 814. Each passage 810 has a resonator 810*b*.

Where the suction pipe length is increased to increase the silencing effect, resonance sounds are generated in the suction pipe and the noises will be controlled by the silencing effect. But, if the resonance sounds become so large that the entire noise level will not reduce, this will be solved by the resonators.

Figure 31:
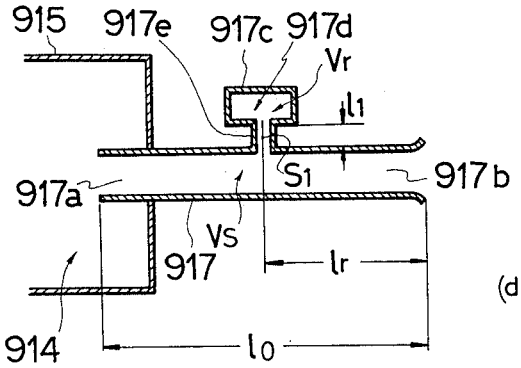
FIG. 31 is an explanatory view of an embodiment providing the suction pipe with a resonator.

FIG. 31 shows an expansion chamber 914 formed by an air cleaner case 915 communicating with the atmosphere through a suction pipe 917. Pipe 917 has its outlet part 917*a* within chamber 914, and its inlet part 917*b* open to the atmosphere.

Figure 32:
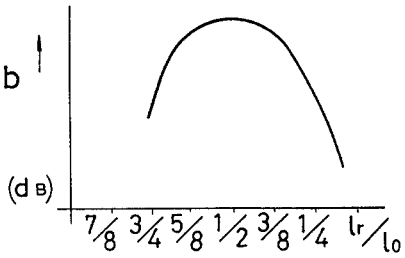
FIGS. 32 to 34 are graphs explaining the embodiment of FIG. 31.

Pipe 917 is provided with a resonator 917*c* having a resonance chamber 917*d* communicating with the interior of pipe 917. Resonator 917*c* projects above pipe 917. Chamber 917*d* communicates with pipe 917 through a communicating part 917*e*.

Where the entire length of pipe 917 is $l_o$, and the length from the open end of inlet part 917*b* to the center position of resonator 917*c* is $l_r$, the degree of attenuation of suction noises was determined by experiment with the results shown in FIG. 32.

Figure 33:
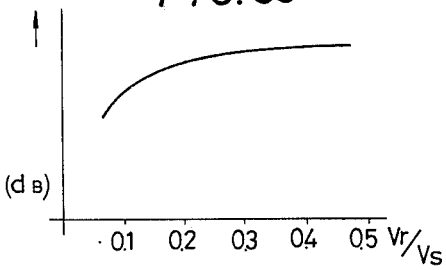

In FIG. 32, the abscissa represents the ratio $l_r/l_o$, and the ordinate represents attenuation in dB. The attenuation curve shows that when $l_r/l_o$ is $\frac{1}{2}$, i.e, in a range of $\frac{3}{8}$ to $\frac{5}{8}$, the most desirable attenuation is obtained. When it exceeds this range, the attenuation decreases markedly. The fitting position of resonator 917*c* to pipe 917 should be regulated to be in the range of $\frac{5}{8} \geqq l_r/l_o \geqq \frac{3}{8}$.

Where the volume of chamber 917*d* is $V_r$, and the volume of pipe 917 is $V_s$, the attenuation curve is shown in FIG. 33. In the range of $V_r/V_s \geqq 0.1$, the silencing effect is greatest. It is desirable that the volume of chamber 917*d* be more than 10% the volume of pipe 917.

If the volume $V_r$ of resonator 917*c* is increased to be more than 30% the volume $V_s$ of pipe 917, the attenuation effect will stop. The upper limit of $V_r/V_s$ should be properly considered.

Figure 34:
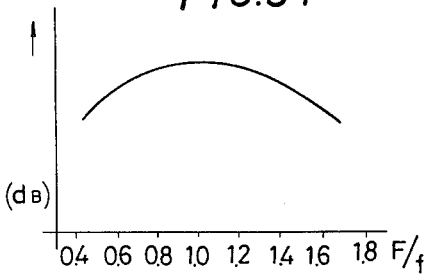
Figure 36:
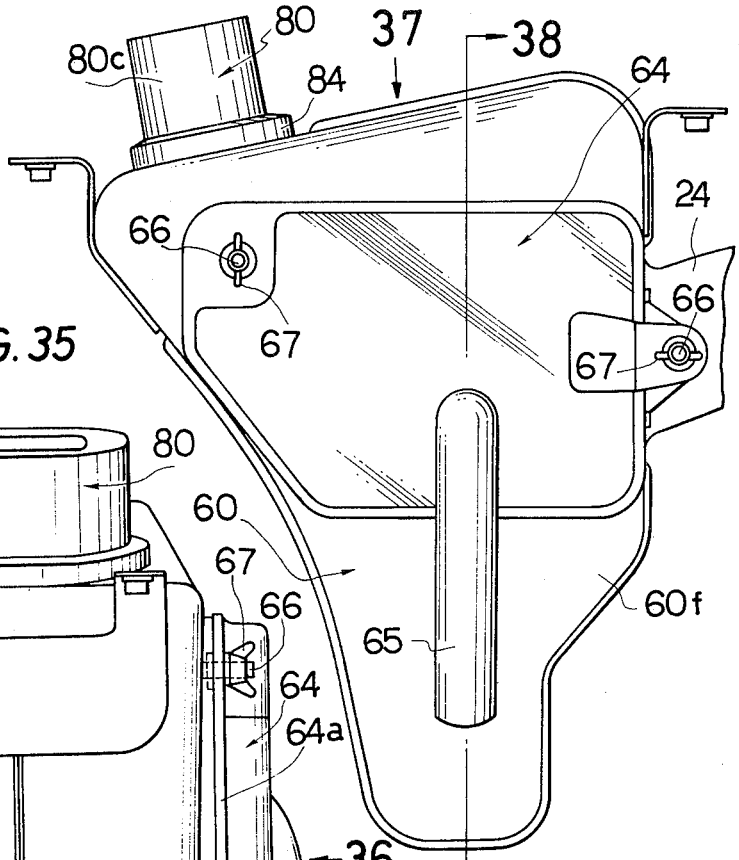
FIG. 36 is a view as seen in the direction indicated by the arrow 36 in FIG. 35.
Figure 35:
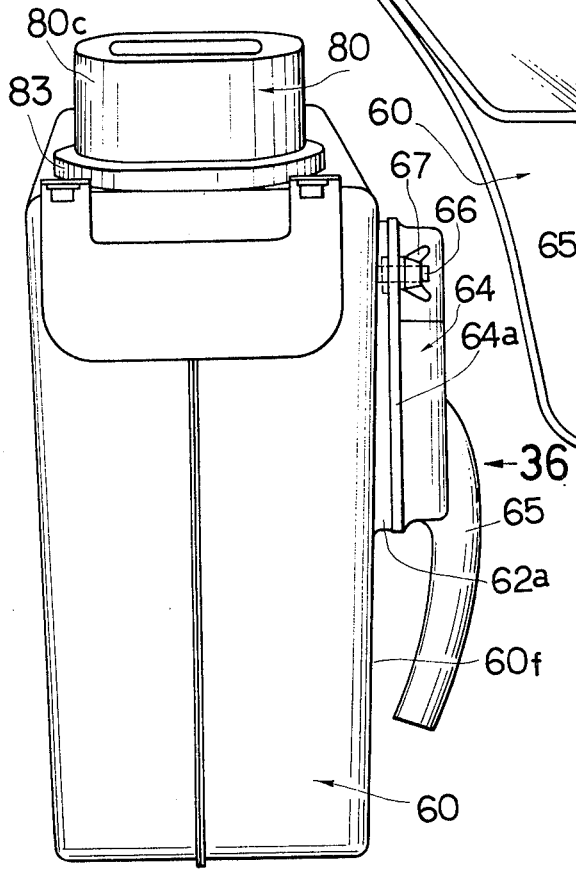
FIG. 35 is a view of the air cleaner case shown in FIG. 8 as seen in the direction indicated by the arrow 35.
Figure 37:
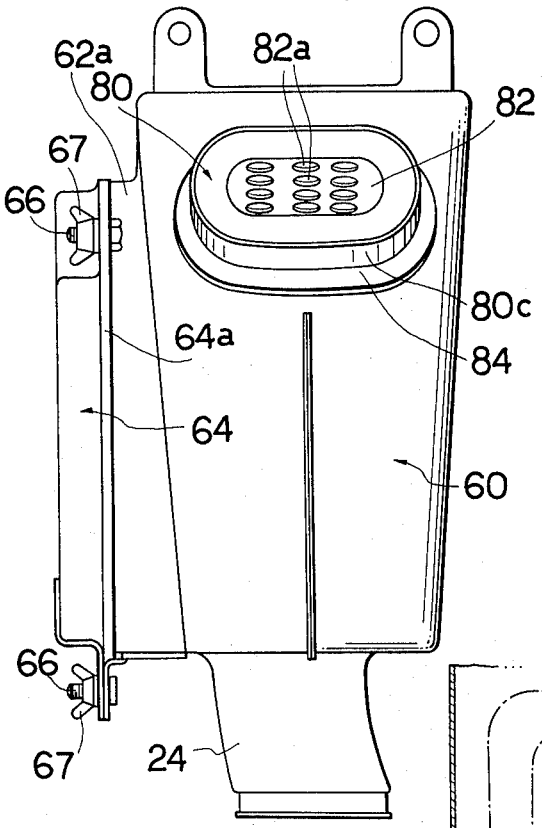
FIG. 37 is a view as seen in the direction indicated by the arrow 37 in FIG. 36.
Figure 39:
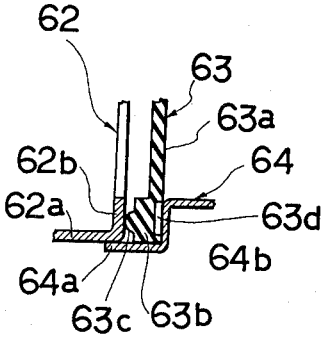
FIG. 39 is a magnified view of a part of FIG. 38.
Figure 38:
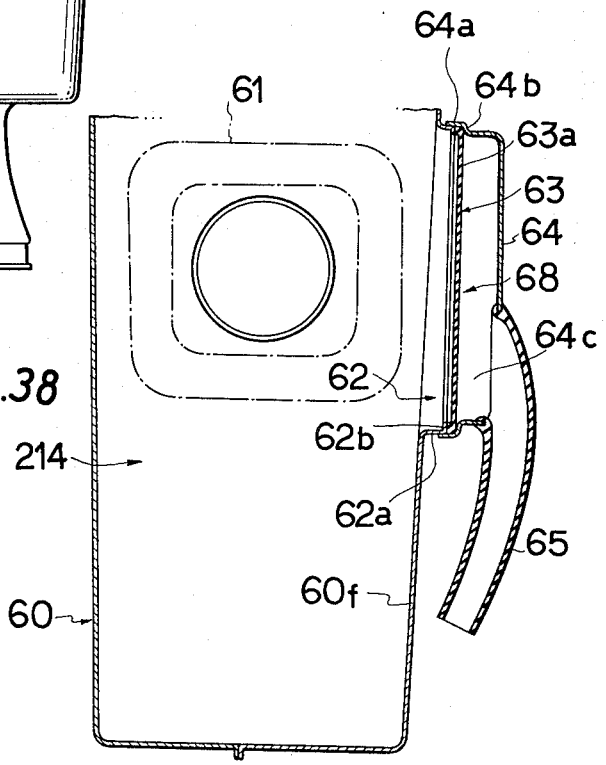
FIG. 38 is a sectioned view on line 38—38 in FIG. 36 showing only a portion thereof.

When the ratio of the frequency $F=C/2\pi\sqrt{S_1/V_r l_1}$ of the vibration characteristic of the structure itself, where $S_1$ is the cross-sectional area of part 917*e*, and $l_1$ is the length of part 917*e*, to the frequency $f=C/2\ l_o$ of the air column vibration, where C is the sound velocity, and $l_o$ is the suction pipe length, is selected to be in a range of $0.7<F/f<1.3$ from the graph shown in FIG. 34, desirable attenuation of the suction noises is obtained.

The frequency of the air column vibration includes the frequency higher than the primary frequency, but its level is comparatively so low that it can usually be neglected. However, a countermeasure against such higher frequency may be freely selected and practiced.

In order for the FIG. 8 structure to function well as an expansion chamber, the air cleaner is provided with means for attenuating and controlling noises as set forth below.

The expansion chamber makes a pressure fluctuation as caused by the periodical pressure fluctuation of the suction passage, and is therefore required to make a breathing action. Therefore, a partition plate formed by a flexible elastic plate, such as of rubber, is provided in a part within the expansion chamber to follow the pressure fluctuation within the chamber. If the partition plate is covered on the outside with a punched plate, a vibration based on the breathing action of the rubber partition plate and radiation of the passing sounds within will be made, and this part will become a new source of noises.

FIGS. 8 and 35–42 show how the above problem is solved by an air cleaner case 60 formed to have a box-shaped body that is substantially an inverted triangle in its side view. One side plate 60*f* is provided with an opening 62 covering substantially the entire length in the forward and rearward direction. An outward bent and projected flange part 62*a* is formed over the entire periphery on the peripheral edge of opening 62. A contact part 62*b* is formed inwardly on the entire periphery at the outside end of part 62*a*. Opening 62 is present on one side of an air cleaner element 61 removably provided within case 60 and is much larger than element 61.

Figure 41:
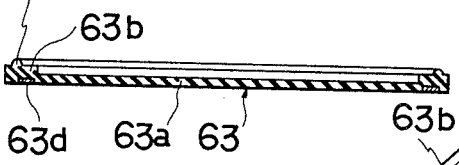
FIG. 41 is a sectioned view on line 41—41 in FIG. 40.
Figure 40:
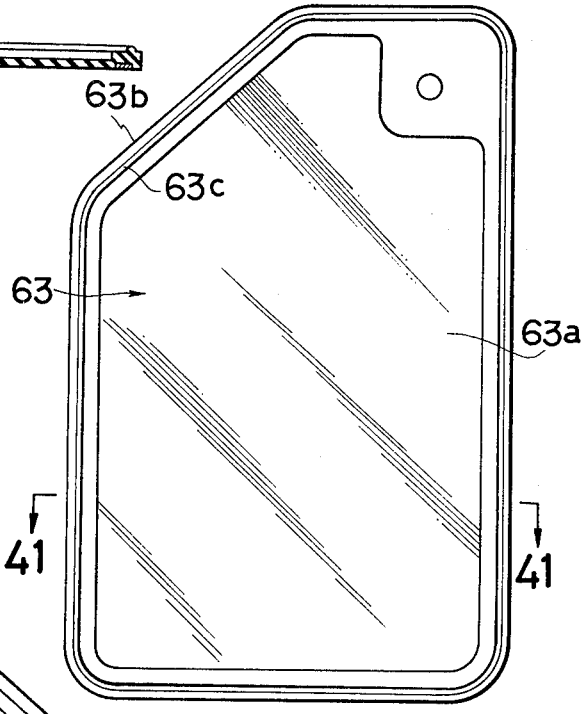
FIG. 40 is an elevation of an elastic partition plate.
Figure 42:
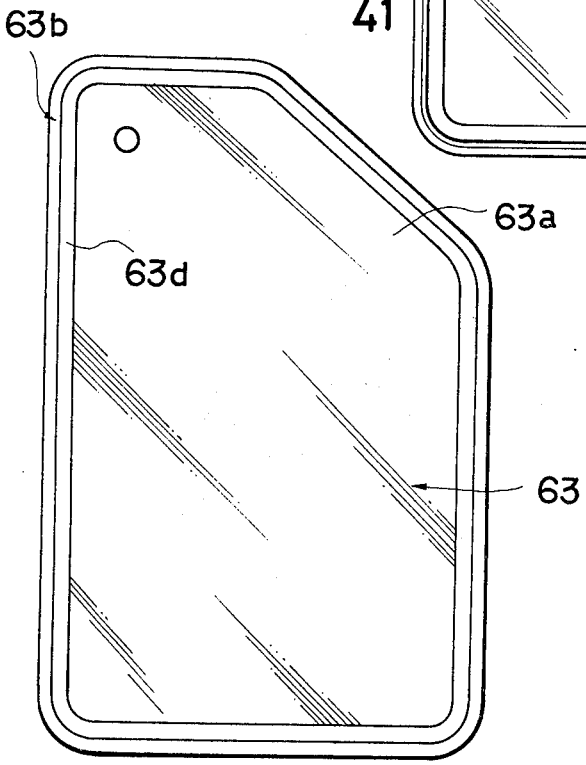
FIG. 42 is a back view of the elastic partition plate.

Opening 62 is closed with an elastic partition plate 63 of rubber or the like. As shown in FIGS. 40 to 42, plate 63 has a shape and size fitting on the outer peripheral edge to the end surface of part 62*b*. Body 63*a* of plate 63 is thin and is provided with a thick end edge part 63*b* to surround the entire periphery. A sealing lip 63*c* is provided by integrally providing a rib to project on the front surface of part 63*b* to surround the entire periphery of plate 63. On the back of part 63*b* a narrow band-shaped reinforcing member 63*d* is provided to surround body 63*a*. Member 63*d* is metal or hard synthetic resin, and is integrally embedded in part 63*b* at the time of forming plate 63, or as integrally bonded with a binder in a groove formed in advance.

A cover 64 has a flange 64*a* bent inwardly to closely fit part 62*a*, and has a step 64*b* formed in its inner portion. Cover 64 has a through hole 64*c* in which a pipe 65 is connected.

Plate 63 is fitted to part 62*b* with lip 63*c* directed toward opening 62. Cover 64 is screw-fastened by bolts 66 and wing nuts 67 to be integrally connected to side plate 60*f* of case 60. By this screw-fastening, part 63*b* is pressed against 64*b* (FIG. 39), and lip 63*c* is pressed against part 62*b* to positively seal opening 62.

Thus, an expansion chamber 214 having opening part 62 sealed and sectioned with elastic partition plate 63 is formed within case 60. Plate 63 is covered on the outside by cover 64. Auxiliary chamber 68, communicating with the atmosphere only through pipe 65, is provided adjacent to chamber 214.

After the pressure fluctuation generated by the intermittent suction operation of the engine within chamber 214, the body 63*a* is deformed, slows the quick pressure drop, improves the suction efficiency and increases the output. Vibration sounds of plate 63 are generated and the passing sounds of suction noises are radiated within chamber 68. Chamber 68 acts as an expansion chamber of small volume to attenuate, control and reduce such noises, and communicates with the atmosphere only through pipe 65 having a predetermined length and cross-sectional area. The noises are attenuated by the muffler action of pipe 65 and the silencing action of chamber 68.

FIGS. 43 to 47 show a means using the above suction pipe with sound absorbing material as a modification of the FIGS. 8 and 21 embodiments.

A suction pipe 80 consists of a body 86 and an inner pipe or holder member 82 that bears sound absorbing material 81. Body 86 is tubularly formed to have a predetermined small diameter and length. An expanded part 85 of larger diameter is a sound absorbing material holding part. The cross section of the suction pipe may be elliptic. Part 85 is concentric with body 86 and is opened at its tip. Part 85 has a step part 85*a*, and is continued and joined to communicate with body 86. A fitting part 86*b* is formed inside a connecting part 86*a* of step 85*a*, and has an engaging concave part 86*c* in the form of a ring.

Pipe 82 has a plurality of through holes 82*a*, an engaging rib 82*c* to engage part 86*c*, and a flange part 82*b* to closely fit the inside diameter of part 85.

Figure 43:
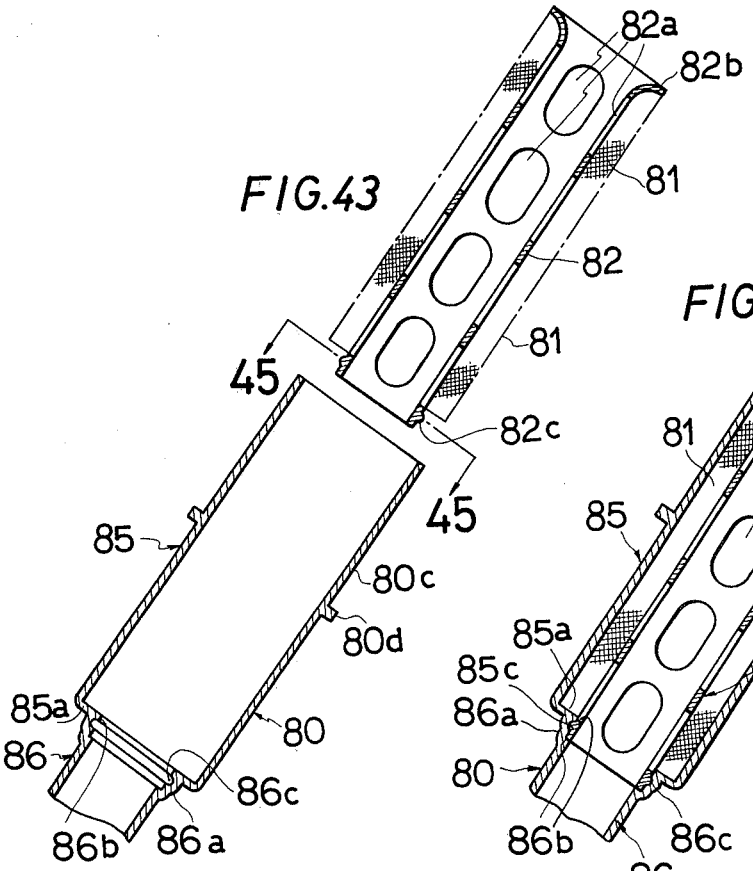
FIG. 43 is a view of means of fitting the suction pipe with sound absorbing material as disassembled and vertically sectioned.
Figure 44:
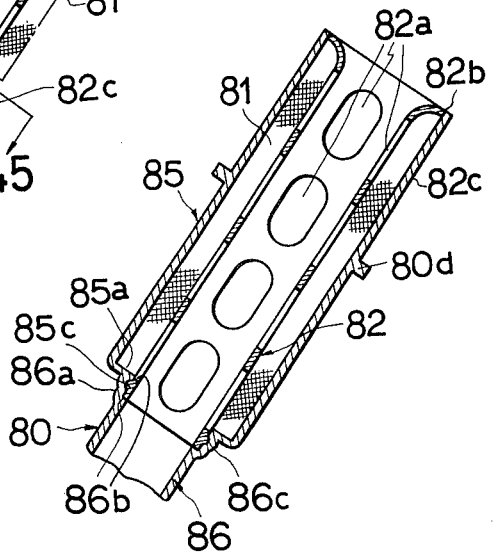
FIG. 44 is a view of FIG. 43 assembled.
Figure 45:
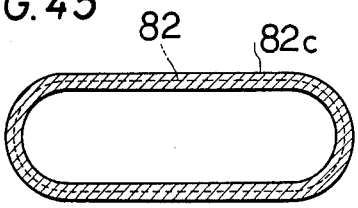
FIG. 45 is a sectioned view on line 45—45 in FIG. 43.

As shown in FIG. 43, pipe 82 has sound absorbing material 81 wound on its outer periphery, and is then inserted into part 85 through the open end of the base. Pipe 82 is then pressed in so that rib 82*c* engages with part 86*c* and is butted into fitting part 86*b*. Material 81 is held between part 85 and pipe 82.

Figure 46:
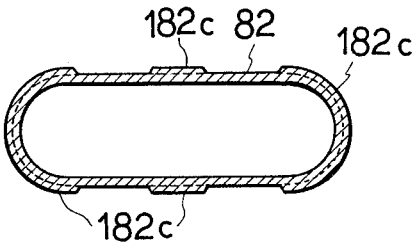
FIG. 46 is a view of a modification of FIG. 45.
Figure 47:
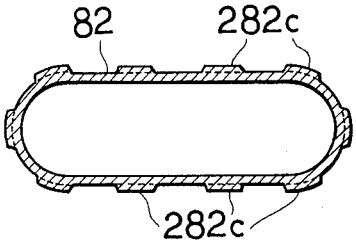
FIG. 47 is a view of a further modification of FIG. 45.

Rib 82*c* is provided on the entire periphery. Considerable pressure is required to engage rib 82*c*. Therefore, as shown in FIG. 46, a rib 182*c* may be provided divided into a plurality of parts. Also, as shown in FIG. 47, many ribs 282 may be provided reduced in peripheral length. Either one can make the engagement easy.

By the above, the sound absorbing material and holder can be fitted to the suction pipe without screwing and welding, the component parts are few, and assembly is easy.

We claim:

1. Apparatus for silencing suction noises of an internal combustion engine, comprising:

at least one suction passage including a suction valve of said engine, a suction path conduit, and portions of a fuel feeding device for said engine;

at least one suction pipe of substantially constant cross section having one end thereof communicating with the atmosphere;

an expansion chamber interposed between and communicating with said suction passage and said suction pipe;

said expansion chamber having a cross-sectional area larger than that of said suction passage, and a substantial volume;

the ratio of the length l of said suction pipe to the length L of said suction passage is in a range of 0.7 to 1.4;

a resonator provided above said suction passage so as to communicate with said passage;

each combustion chamber of a multicylinder engine being made to communicate with said expansion chamber through an independent suction passage provided with a fuel feeding device; and each said independent suction passage being provided with its own said resonator.

2. Apparatus according to claim 1, wherein:

the length of said suction passage is $l_o$;

the distance from said suction valve to the suction passage communicating part of said resonator is $L_r$; and said resonator is positioned such that $L_r/L_o \leqq 0.4$.

3. Apparatus according to claim 1, wherein:

said resonator (710*b*) is provided on a connecting pipe (710*a*) disposed between said suction passage (710) and a carburetor (713) of said fuel feeding device.

* * * * *